US009700112B1

(12) United States Patent
Samson

(10) Patent No.: US 9,700,112 B1
(45) Date of Patent: Jul. 11, 2017

(54) SYSTEM FOR PROTECTING ELECTRONIC DEVICES

(71) Applicant: Scott W. Samson, Spofford, NH (US)

(72) Inventor: Scott W. Samson, Spofford, NH (US)

( * ) Notice: Subject to any disclaimer, the term of this patent is extended or adjusted under 35 U.S.C. 154(b) by 84 days.

(21) Appl. No.: 14/523,136

(22) Filed: Oct. 24, 2014

(51) Int. Cl.
*F16B 9/02* (2006.01)
*A45C 11/00* (2006.01)

(52) U.S. Cl.
CPC ..... *A45C 11/00* (2013.01); *F16B 9/02* (2013.01); *A45C 2011/003* (2013.01)

(58) Field of Classification Search
CPC ..... A45C 11/00; F16B 9/02
See application file for complete search history.

(56) References Cited

U.S. PATENT DOCUMENTS 6,530,475 B1 * 3/2003 Penney ..... G06F 1/1628 190/110
8,490,783 B1 * 7/2013 Fan ..... H04M 1/185 206/45.23
9,307,656 B2 * 4/2016 Murchison ..... H05K 5/0013
2009/0009945 A1 * 1/2009 Johnson ..... G06F 1/1613 361/679.27
2010/0147737 A1 * 6/2010 Richardson ..... A45C 11/00 206/701
2010/0171021 A1 * 7/2010 Smith ..... A45C 13/30 248/558
2011/0031287 A1 * 2/2011 Le Gette ..... F16M 11/04 224/101
2011/0192743 A1 * 8/2011 May ..... A45C 13/002 206/320
2012/0024741 A1 * 2/2012 Beatty ..... A45C 11/00 206/521
2012/0043235 A1 * 2/2012 Klement ..... A45C 11/00 206/320
2012/0224323 A1 * 9/2012 Yang ..... F16M 11/041 361/679.55
2012/0275025 A1 * 11/2012 Parrill ..... G02B 23/16 359/511
2013/0067967 A1 * 3/2013 Olear ..... E05B 73/0005 70/18
2013/0092562 A1 * 4/2013 Wyner ..... A45C 11/00 206/45.23
2014/0138265 A1 * 5/2014 Bong ..... A45C 11/00 206/37
2014/0196348 A1 * 7/2014 Samson ..... F41C 27/00 42/90

(Continued)

*Primary Examiner* — Brian D Nash
(74) *Attorney, Agent, or Firm* — Burns & Levinson LLP; Bruce D. Jobse

(57) ABSTRACT

A protective system for electronic devices has a plurality of corner protectors interconnected by pairs of removably securable rails. The corner protectors may include an indentation on a surface thereof for receiving and seating the corner of an electronic device. The dimensions of the protective system relative to the electronic device define a protective perimeter such that if the device is dropped on a substantially planar surface the sides and front or back surface of the electronic device are protected from direct contact. The protective system may be used in conjunction with an attachment mechanism which is securable about one or more pairs of rails of the protective system to allow mounting of the protective system to items and surfaces such as a rail mount accessory of a firearm.

20 Claims, 5 Drawing Sheets

(56) References Cited

U.S. PATENT DOCUMENTS

| | | | | |
|---|---|---|---|---|
| 2014/0215764 | A1* | 8/2014 | Sung | A45F 5/00 24/3.13 |
| 2014/0216971 | A1* | 8/2014 | Ashley | A45C 11/00 206/472 |
| 2015/0001104 | A1* | 1/2015 | Kim | A45C 11/00 206/37 |
| 2015/0129452 | A1* | 5/2015 | Richardson | B65D 81/022 206/523 |

* cited by examiner

SYSTEM FOR PROTECTING ELECTRONIC DEVICES

FIELD OF THE INVENTION

The disclosure relates to electronic devices, and, more specifically, to a system to physically protect devices such as cell phones, smart phones and tablet computers.

BACKGROUND OF THE INVENTION

Electronic devices such as cell phones, smart phones and tablet computers have become immensely popular in recent years. Such devices provide the convenience of both computational power and communication facilities with mobility. These devices are highly sophisticated and include delicate electronics. Their frequent use and portability exposes such devices to an increased risk of traumatic shock from being dropped, struck or exposed to various other environmental conditions. A number of different protective devices and carrying cases are commercially available, however, many of these are cumbersome, being not only aesthetically unpleasing, but adding to the weight of the device and prevent proper heat dissipation from the device. Still further, many such protection devices do not provide adequate shock absorption or shock distribution capabilities and, therefore, do not truly protect the sensitive electronics within such devices.

Accordingly, need exists for a protective mechanism for use with portable electronic devices which provides improved shock absorption and shock distribution characteristics.

Further need exists for a protective mechanism for use with portable electronic devices which does not significantly increase the weight of the device or interfere with heat dissipation from the device.

A still further need exists for a protective mechanism for use with portable electronic devices which is aesthetically pleasing.

In addition to currently available protective mechanisms, the number of different device holders are available for use in, for example automobiles or on office desktops, tables, etc. Unfortunately, many of these device holders work only with the original dimensions of the electronic device, e.g. a cell phone or smartphone, and are not intended to accommodate the increased dimensional profile of a device in combination with a protective mechanism, sometimes requiring the user to remove the protective mechanism so that it can be placed in the device holder. Further, many such holding devices provide limited or no degrees of motion once the device is attached.

Accordingly, further need exists for a protective case which can be used in combination with a device holder attachment which does not require removal of the protective mechanism.

A still further need exists for a protective case which can be used in combination with a device holder attachment which provides multiple degrees of freedom, including tilting and rotation, without requiring removal of the protective mechanism from the electronics device.

SUMMARY OF THE INVENTION

Disclosed is an apparatus and system for protecting electronic devices such as cell phones, smart phones and tablet computers. The system comprises a plurality of corner protectors securable to the corners of the rectangular perimeter of an electronic device and sets of rails extending between the corner protectors and removably securable thereto. The corner protectors and rail sets provide a minimalist, aesthetically pleasing protective cage which surrounds electronic device and reduces the chances of direct contact with the device from a parallel surface or from a range of off axis angles thereto. The configuration of the protective system distributes force imparted to any of the corner protectors or rails throughout the protective system about the perimeter of the device and transmits force to the device only through the plurality of corner protectors, thereby mitigating the amount of force incident on the device itself.

According to one aspect of the disclosure, a protective system for electronic devices comprises a plurality of corner protectors interconnected by pairs of removably securable rails. In one embodiment, the rails have threaded ends securable to the corner protectors. In one embodiment, the corner protectors include an indentation on a surface thereof for receiving and seating the corner of an electronic device. The dimensions of the protective system relative to the electronic device define a protective perimeter such that if the device is dropped on a substantially planar surface the sides and front or back surface of the electronic device are protected from direct contact. In one embodiment, the protective system may be used in conjunction with an attachment mechanism which is securable about one or more of rails of the protective system to allow mounting of the protective system to items and surfaces such as a rail mount accessory of a firearm. In one embodiment, the attachment mechanism comprises one or more pivotally and/or rotatably movable joints to provide for multiple degrees of freedom to tilt and rotate the protective system and the electronic device relative to a surface of attachment.

According to one aspect of the disclosure, a method of protecting an electronic device comprises: providing a plurality of corner protectors, each configured to receive a corner of an electronic device, and a plurality of rails removably interconnectable to the plurality of corner protectors; and assembling the plurality of corner protectors and the plurality of rails about the electronic device so as to collectively define a protective system about a perimeter of the electronic device which prevents direct contact with the electronic device by a substantially planar surface. In one embodiment, the method further comprises removably securing a mounting mechanism to the protective system.

DESCRIPTION THE DRAWINGS

DETAILED DESCRIPTION

The present disclosure will be more completely understood through the following description, which should be read in conjunction with the drawings. The skilled artisan will readily appreciate that the methods, apparatus and systems described herein are merely exemplary and that variations can be made without departing from the spirit and scope of the disclosure.

Figure 1:
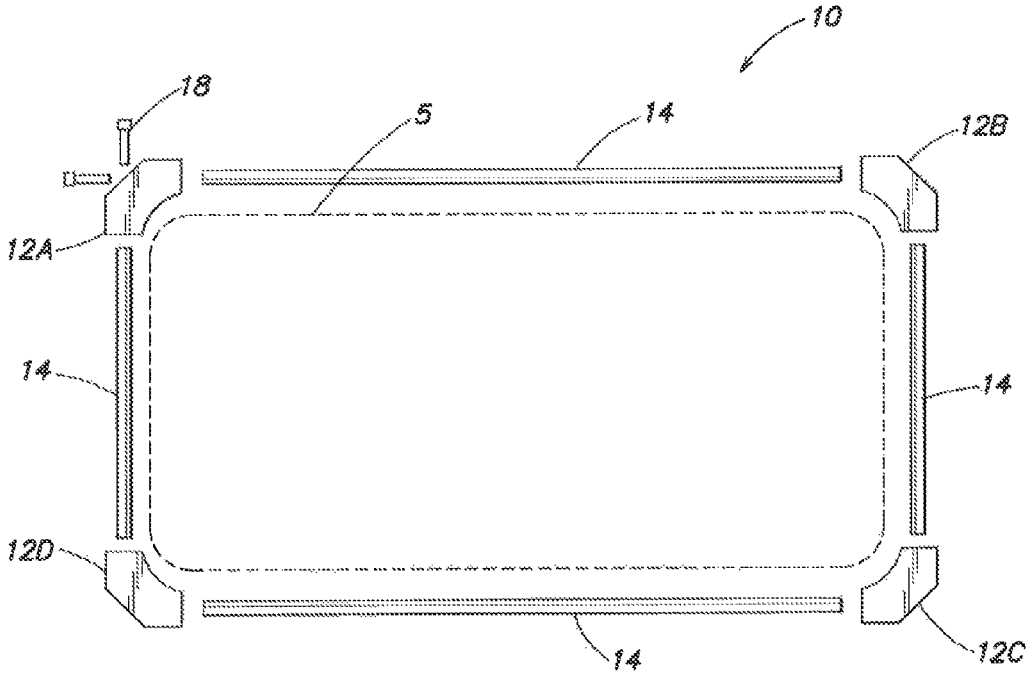
FIG. 1 illustrates conceptually an exploded top plan view of a protective system relative to an electronic device in accordance with the disclosure.
Figure 2:
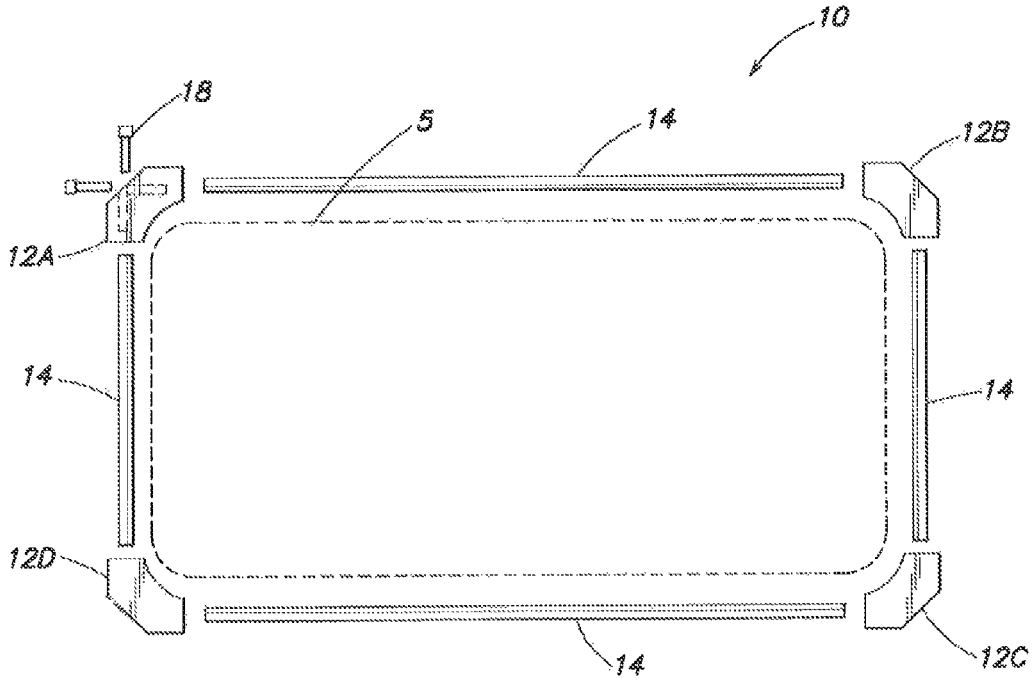
FIG. 2 illustrates conceptually another exploded top plan view of the protective system of FIG. 1 relative to an electronic device in accordance with the disclosure.
Figure 3:
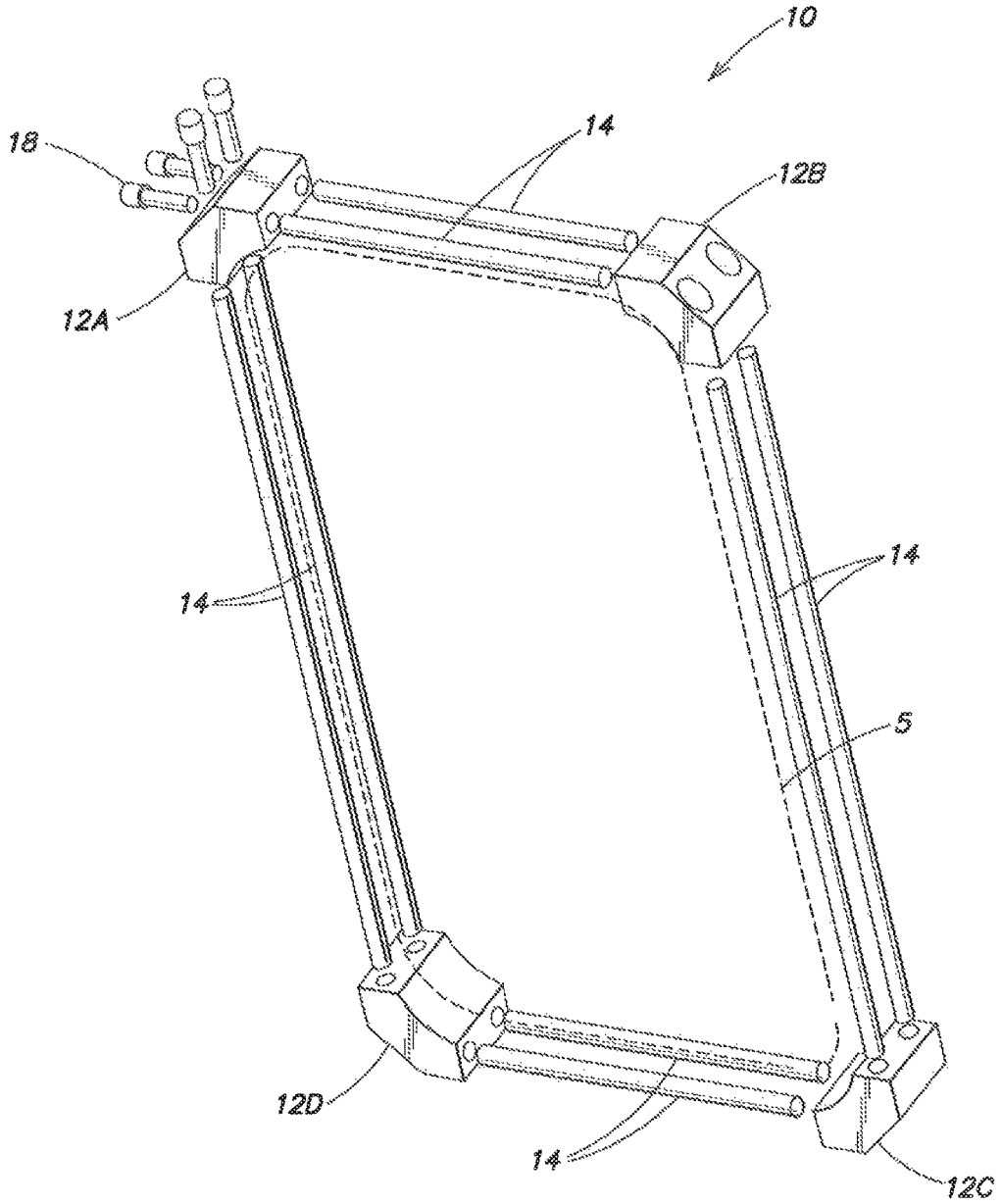
FIG. 3 illustrates conceptually an exploded perspective view of the protective system of FIGS. 1 and 2 relative to an electronic device in accordance with the disclosure.

Referring to the Figures, a protective system 10 surrounds and creates a protective perimeter about an electronic device 5, as illustrated. Device 5 may comprise any number of currently available electronic devices, including, but not limited to, cell phones, smart phones, tablet computers, etc. which are substantially planar and characterized by rectangular perimeter profiles with slightly rounded corners and relatively thin widths between their respective top and bottom surfaces, the electronic device 5 being shown for illustrative purposes only and not intended to be limiting or part of the protective system As illustrated in FIGS. 1-3, protective system 10 comprises a plurality of corner protectors 12A-D interconnected by a plurality of rails 14. Corner protectors 12A-D may have a first or exterior surface which is either beveled, as illustrated in the Figures, or may be continuously rounded. A second or interior surface of corner protectors 12A-D, as illustrated in FIG. 3, includes an indentation or cavity sized and shaped to receive and to frictionally retain therein a corner of electronic device 5.

In the illustrative embodiment, each of corner protectors 12A-D has first and second ends containing at least two apertures for receiving the ends of rails 14. In one embodiment, such apertures contain a complementary threaded interior for receiving a threaded end of a rail 14. In other embodiments, one or all of corner protectors 12A-D have end apertures which are smooth bored to receive smooth ends of some rails 14 which include a hollow interior end capable of receiving a screw or pin 18 introduced through the corner protector 12 through another aperture on an opposing surface thereof, as illustrated by corner protectors 12D.

In one embodiment, corner protectors 12A-D are formed of a rigid or semi rigid material which is capable of withstanding direct shock thereto. In one embodiment, corner protectors 12A-D may have a unitary construction made of any of natural or synthetic resins or combinations thereof, including plastics, polyester, polyethylene, or even ballistic grade plastic. In another embodiment, corner protectors 12A-D may have a similar construction but with an exterior coating such as rubber, foam or other energy absorptive material integrally formed therewith or applied thereto to increase the shock absorbing value of the protector. In one embodiment, not all of corner protectors 12A-D have a homogeneous design or material composition.

Rails 14 are substantially cylindrical in shape and, as indicated, may have an exterior threading proximate one of both ends thereof or may have a hollow end with or without an internal thread for receiving screws 18. Rails 14 may be formed of any rigid material, natural or synthetic materials, including metals and plastics. In one embodiment, rails 14 may have an exterior coating such as rubber, foam or other energy absorptive material integrally formed therewith or applied thereto to increase the shock absorbing value of the rail. In one embodiment, not all of rails 14 have a homogeneous design or material composition. For example, of the four paired sets of rails 14 illustrated in FIGS. 1-2, two of the paired sets may be securable to their respective corner protectors 12 A-C by being threaded directly into the ends of the corner protectors while the other two of the paired sets of rails may be securable to their respective corner protectors 12A and 12C by being threaded directly into the ends of the corner protectors at one end of each rail and secured with a pair of screws 18 into the corner protector 12D at the other end of the rails.

In the illustrative embodiment, screws 18 may be introduced into one or more of corner protectors 12A-D through an aperture, as illustrated in phantom in FIGS. 1-2. In one embodiment, Screws 18 baby implemented with 16X pin rivet screws that do not require a complementary threaded surface at the ends of rails 14.

The dimensions of corner protectors 12A-D and rails 14 of protective system 10 may be sized to accompany the specific dimensions of a particular electronic device 5 or may be designed to accommodate a limited range of device dimensions. For example, the indentation or cavity in corner protectors 12A-D may be lined with a compressible foam which is capable of receiving and frictionally retaining the rounded corners of a number of different electronic devices 5 having a range of dimensions. In addition, the amount of exterior threading at the ends of rails 14 and the depth of the complementary apertures in corner protectors 12 may be manufactured for accommodating electronic devices with slightly differing exterior perimeter dimensions.

Rails 14 in combination with corner protectors 12A-D define a protective perimeter about electronic device 5 such that if the device is dropped on a substantially planar surface, the front or back surface of the electronic device 5 are protected from direct contact since the thickness of corner protectors 12A-D is of a greater dimension than the width of the electronic device. In addition, the rails 14 provide a barrier against a direct strike to the sides of the electronic device while corner protectors 12A-D additionally provide a bumper to absorb any direct shocks to the corners of electronic device 5, as may be caused by dropping the device.

Because of the rail and corner configuration of protective system 10, energy imparted to any part of the protective system will be partially distributed throughout the projective system 10 and about the perimeter of the electronic device 5 with only the rounded corners of the device actually having direct contact with the protective system 10, thereby allowing the energy of the shock to be more evenly distributed about and to the device versus the entire shock being absorbed directly by a specific area of the device.

FIGS. 4A-D illustrate conceptually an embodiment of an attachment mechanism 20 which may be used in conjunction with the protective system 10 and other accessories 30. In one embodiment, attachment mechanism 20 comprises an elongate bracket 22 with a first end 22A having a projection 24 integrally formed therein and extending substantially at a right angle to the long axis of bracket 22. An indentation formed at the juncture of the main body of bracket 22 and first and 22A is shaped to seat and frictionally engage rail 14.

A second end 22B of bracket 22 includes a threaded aperture into which a clamp member 26, having an L-shaped cross-sectional profile, is securable with a threaded knob extending through member 26. In the disclosed embodiment, the short leg 26A of L-shaped clamp member 26 has a triangular or tapered cross-sectional profile for positioning between a pair of rails 14 of protective system 10, while a long leg 26B of L-shaped clamp member 26 includes a threaded aperture for receiving the threaded projection of a knob 25 removably securable therein.

Figure 4A:
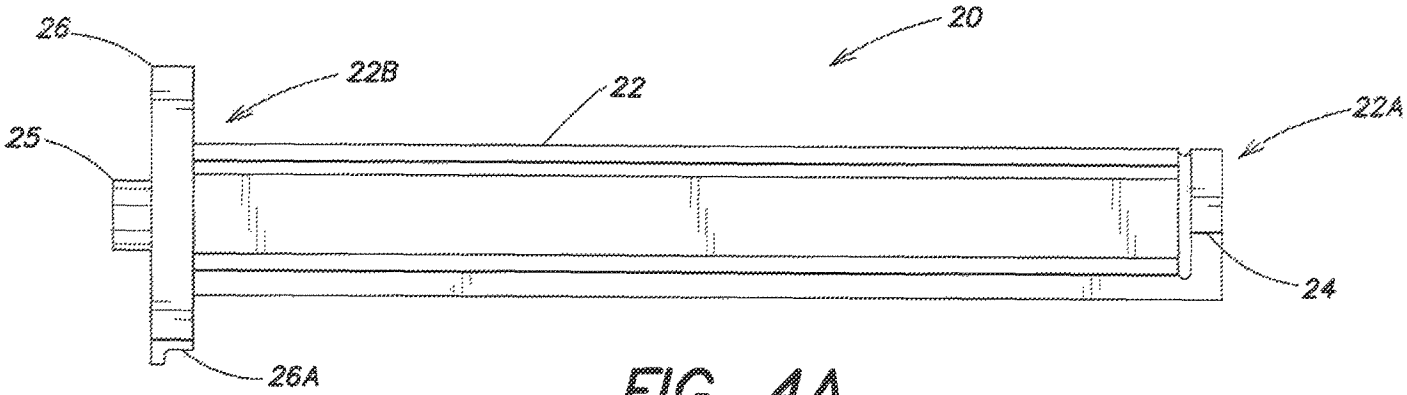
FIGS. 4A-D illustrate conceptually an embodiment of an attachment mechanism which may be used in conjunction with the protective system of FIGS. 1-3 and other accessories in accordance with the disclosure.
Figure 4B:
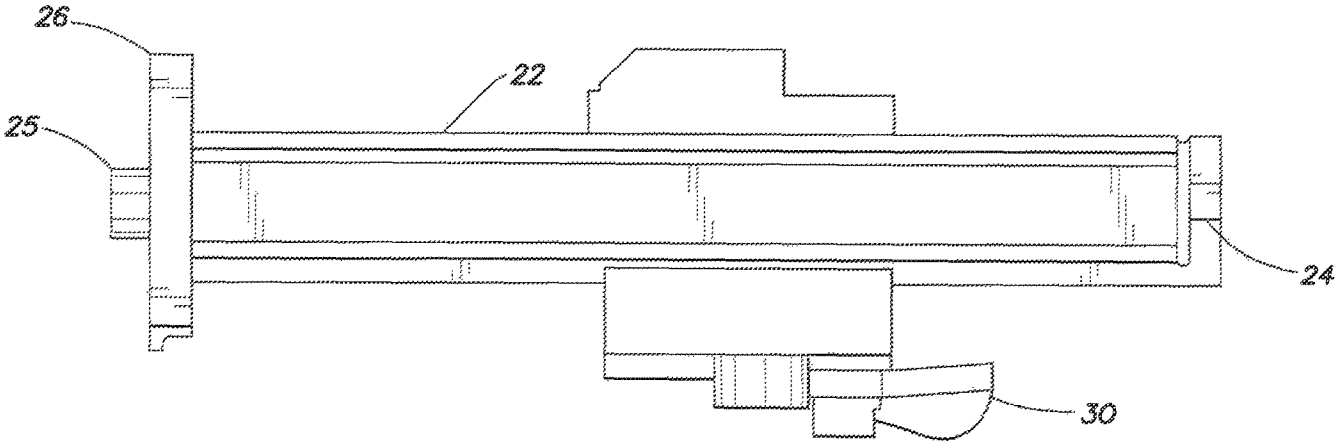
Figure 4C:
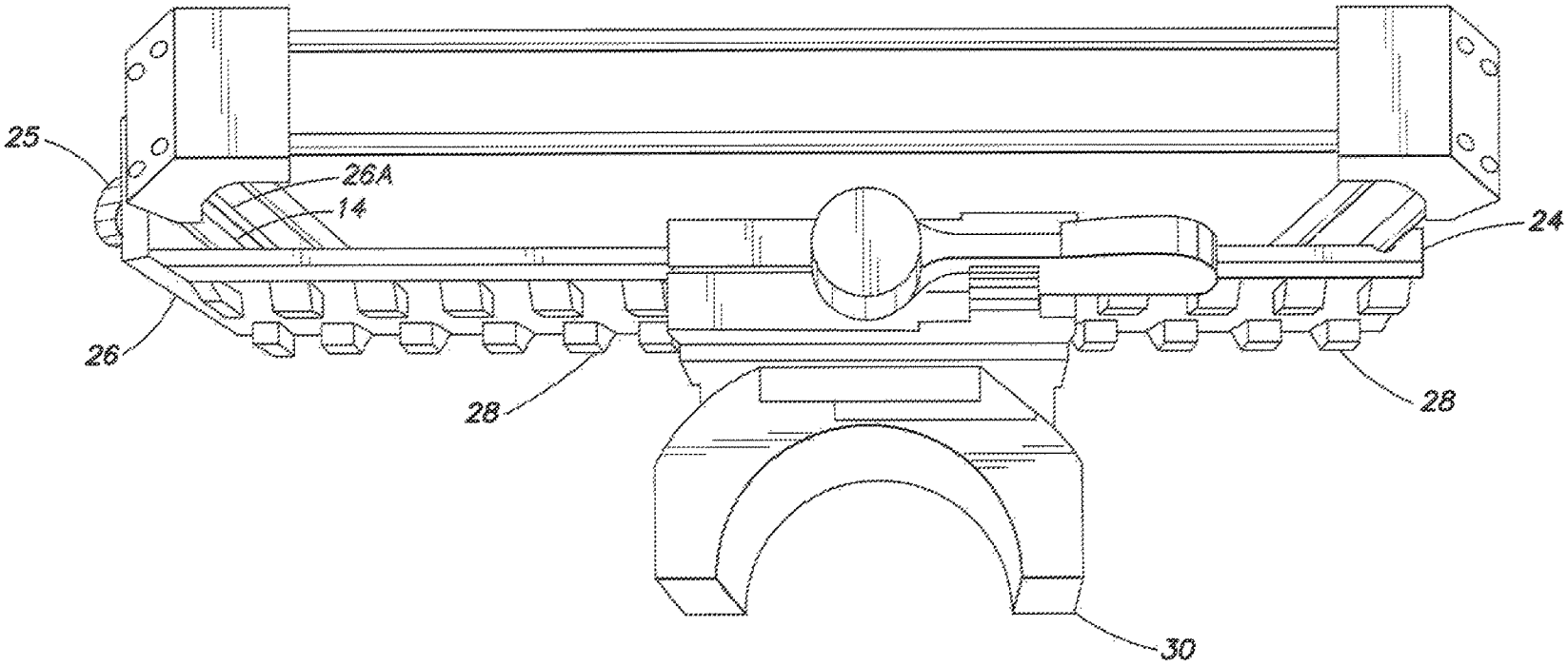
Figure 4D:
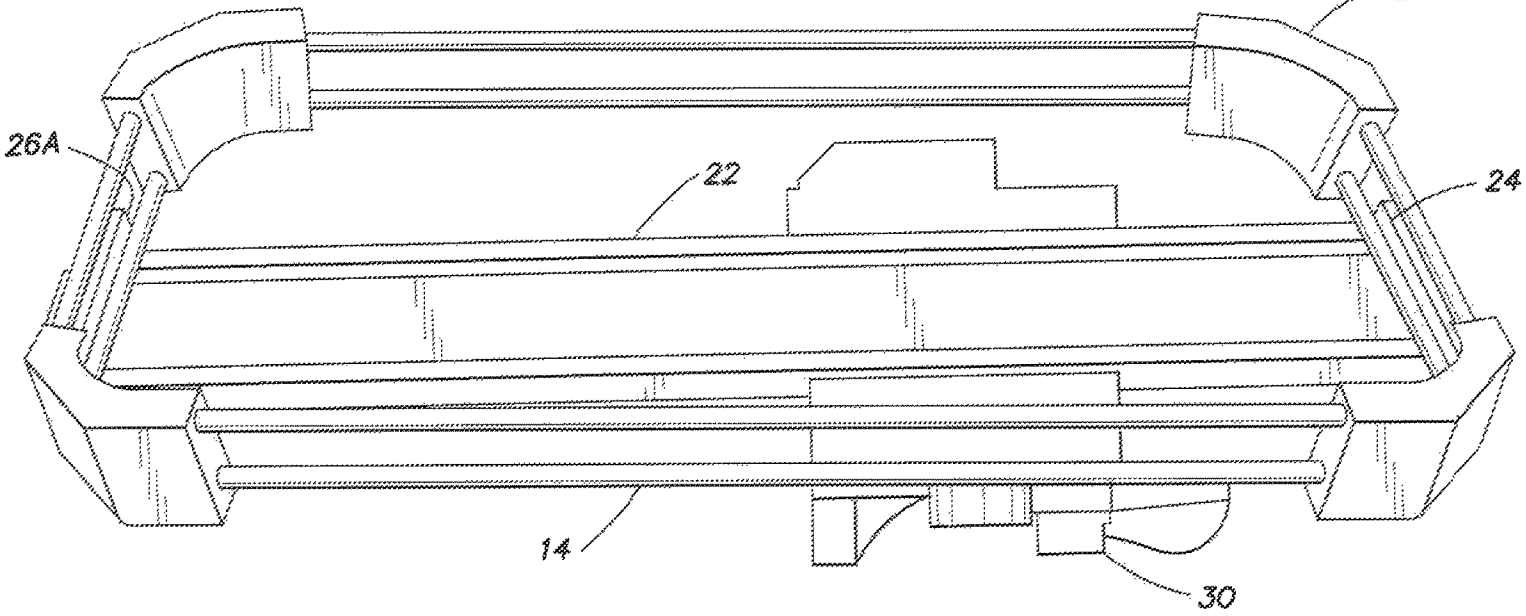

A surface of bracket 22 opposite that adjacent protective system 10 may be provided with features to facilitate attachment of the bracket to various surfaces or devices. For example, in the illustrative embodiment, such surface is provided with a series of spaced projections 28 which may be similar or different to those of a rail system used with firearm accessories. As illustrated in FIG. 4C, such features enable the attachment mechanism to be secured to an accessory device 30. In the illustrative embodiment, the accessory device 30 may be any of the mounting accessories in the RAM Base line of firearm mounting accessories, commercially available from Samson Manufacturing Corp., Keene, N.H. 03431, that enables the attachment mechanism to be rapidly secured or removed to/from a firearm. It will be obvious to those reasonably skilled in the arts that other such accessories 30 maybe utilized in conjunction with attachment mechanism 20 and protective system 10, and that bracket 22 may be modified accordingly to accommodate the various features and functionalities of such accessories to interact therewith without parting from the spirit or scope of the invention.

In practice, to secure attachment mechanism 20 to protective system 10, a rail 14 at one end of protective system 10 is seated at end 22A of bracket 22 and clamp member 26 is positioned so that short leg 26A of L-shaped clamp member 26 is disposed between rails 14 at the opposite end of protective system 10. Knob 25 is then used to secure clamp member 26 against end 22B of bracket 22 so that attachment member 20 is secured to and engaged with protective system 10.

In an alternative embodiment, attachment member 20 may further comprise one or more pivotally and/or rotatably movable joints to provide for multiple degrees of freedom to tilt and rotate the protective system 10, and the electronic device 5 retained therein, relative to a surface of attachment or other accessory.

It will be obvious to those reasonably skilled in the art that modifications to the apparatus and process disclosed herein may occur, including substitution of various component or materials, without parting from the true spirit and scope of the disclosure.

What is claimed is:

1. A system for protecting a substantially rectangular electronic device having a plurality of edges, the system comprising:

a plurality of corner protectors each configured to receive and retain a corner of an electronic device;

a plurality of rigid rails removably interconnecting the plurality of corner protectors, a pair of the rails extending in parallel along one of the edges;

wherein the plurality of rigid rails and the plurality of corner protectors collectively define a protective perimeter preventing direct contact with the electronic device by a substantially planar surface; and wherein only the plurality of corner protectors are in contact with the electronic device.

2. The system of claim 1 wherein each of the corner protectors comprises an indentation on a surface thereof for receiving a corner of the electronic device.

3. The system of claim 1 wherein each of the corner protectors comprises a rigid material.

4. The system of claim 1 wherein each of the corner protectors comprises a semi-rigid material.

5. The system of claim 1 wherein at least one of the plurality of rigid rails has a cylindrical shape.

6. The system of claim 1 wherein the plurality of rigid rails are cylindrically shaped.

7. The system of claim 1 wherein at least two of the plurality of rigid rails interconnect and are disposed intermediate adjacent of the corner protectors.

8. The system of claim 1 in combination with a mounting mechanism removably securable to at least one of the plurality of rigid rails.

9. The system of claim 1 in combination with a mounting mechanism removably securable to at least two different of the plurality of rigid rails.

10. The system of claim 9 wherein the mounting mechanism comprises surface features which enable attachment of the mounting mechanism to another device or surface.

11. The system of claim 1 wherein each of the plurality of rigid rails comprises a rigid material.

12. The system of claim 1 wherein each of the plurality of rigid rails comprises a semi-rigid material.

13. A system for protecting a substantially rectangular electronic device comprising:

a plurality of corner protectors each configured to receive and retain a corner of an electronic device; and a plurality of rigid rails removably interconnecting the plurality of corner protectors;

wherein the plurality of rigid rails and the plurality of corner protectors collectively define a protective perimeter preventing direct contact with the electronic device by a substantially planar surface, wherein only the plurality of corner protectors are in contact with the electronic device wherein each of the corner protectors further comprises a plurality of apertures configured for receiving ends of the plurality of rigid rails.

14. A system for protecting a substantially rectangular electronic device comprising:

a plurality of corner protectors each configured to receive and retain a corner of an electronic device; and a plurality of rigid rails removably interconnecting the plurality of corner protectors;

wherein the plurality of rigid rails and the plurality of corner protectors collectively define a protective perimeter preventing direct contact with the electronic device by a substantially planar surface, wherein at least one of the corner protectors further comprises a plurality of apertures configured for receiving a plurality of the screws.

15. An apparatus for protecting a substantially rectangular electronic device having a plurality of edges, the apparatus comprising:

a plurality of corner protectors securable to the corners of a perimeter of an electronic device; and a plurality of rigid rails extending between the corner protectors and removably securable thereto, a pair of the rails extending in parallel along one of the edges, wherein only the plurality of corner protectors are in contact with the electronic device, wherein the plurality of rigid rails and the plurality of corner protectors collectively define a protective system about a perimeter of the electronic device that distributes force imparted to any of the corner protectors or plurality of rails throughout the protective system and transmits force to the electronic device only through the plurality of corner protectors.

16. The system of claim 15 wherein each of the corner protectors comprises an indentation on a surface thereof for receiving a corner of the electronic device.

17. The system of claim 15 wherein each of the corner protectors comprises a rigid material.

18. The system of claim 15 wherein each of the corner protectors comprises a semi-rigid material.

19. A method of protecting a substantially rectangular electronic device having a plurality of edges, the method comprising:

providing a plurality of corner protectors, each configured to receive a corner of an electronic device, and a plurality of rigid rails removably interconnectable to the plurality of corner protectors, a pair of the rails extending in parallel along one of the edges; and assembling the plurality of corner protectors and the plurality of rails about the electronic device so as to collectively define a protective system about a perimeter of the electronic device which prevents direct contact with the electronic device by a substantially planar surface and wherein only the plurality of corner protectors are in contact with the electronic device.

20. The method of claim 19 further comprising:

removably securing a mounting mechanism to the protective system.

* * * * *